United States Patent [19]

Sarkar et al.

[11] Patent Number: 5,001,012

[45] Date of Patent: Mar. 19, 1991

[54] THERMAL TRANSFER DONOR ELEMENT

[75] Inventors: Manisha Sarkar; Charles M. Leir, both of St. Paul, Minn.

[73] Assignee: Minnesota Mining and Manufacturing Company, St. Paul, Minn.

[21] Appl. No.: 299,139

[22] Filed: Jan. 23, 1989

[51] Int. Cl.[5] ..... B41M 5/26

[52] U.S. Cl. ..... 428/447; 428/195; 428/480; 428/488.4; 428/913; 428/914; 503/227

[58] Field of Search ..... 8/471; 428/195, 484, 428/488.4, 447, 480, 913, 914; 503/227

[56] References Cited

U.S. PATENT DOCUMENTS 4,203,883 5/1980 Hangauer, Jr. ..... 260/29.2

4,677,182 6/1987 Leir et al. ..... 528/109

FOREIGN PATENT DOCUMENTS 0250248 12/1987 European Pat. Off. .

J6-1248-093A 6/1985 Japan .

219096 11/1985 Japan ..... 503/227

1227087 10/1986 Japan ..... 503/227

J8-0210-494A 11/1986 Japan .

2003987 1/1987 Japan ..... 503/227

*Primary Examiner*—Pamela R. Schwartz

*Attorney, Agent, or Firm*—Donald M. Sell; Walter N. Kirn; James V. Lilly

[57] ABSTRACT

A donor element for thermal transfer is provided. The donor element comprises a backing having an organopolysiloxane-polyurea anti-stick surface on one side and a heat-activated, image forming material on the other side.

19 Claims, No Drawings

THERMAL TRANSFER DONOR ELEMENT

TECHNICAL FIELD

This invention relates to thermal transfer donor media.

BACKGROUND ART

Thermal transfer recording involves the formation of an image on a receptor by the transfer of a heat-activated, image-forming material from a donor element. Thermal transfer recording includes both mass transfer and diffusion transfer systems. In a mass transfer system the image is formed by the transfer of a colorant to a receptor without the occurrence of a chemical reaction. In a diffusion transfer system, the image is formed on the receptor as a result of the transfer of a chemical reactant from the donor with subsequent reaction with a coreactant on the receptor.

In each system, transfer is achieved by image-wise heating a donor sheet bearing an image-forming material. A thermal print head, which consists of an array of small, electrically heated, elements each of which is preferably computer activated in a timed sequence, is used to produce the desired image. The donor sheet typically comprises a paper or polymer film backing layer having a heat-activated, image-forming layer on its front or top surface.

In the thermal transfer process, the image-forming layer of the donor sheet is usually placed into intimate contact with a receptor surface. The back or opposite side of the donor is contacted to the thermal printhead and the printhead activated to selectively heat the image forming material and transfer it to the receptor. In this process, the donor may be exposed to temperatures of 300° C. or higher for short periods of time in order to cause transfer.

Regardless of the system used to bring about transfer, it is generally the case that such material must be carried on a backing. Contact of the backing to the thermal printhead however, has been found to cause a number of problems. For example, contact can abrade the thermal printhead. Moreover, many of the commonly used backing materials are thermoplastic and have a tendency to soften and stick to the printhead during the imaging step. Each of these factors can reduce the efficiency and accuracy of the elements and cause poor print quality.

A wide variety of solutions to these problems have been suggested. They include, for example, the use of heat resistant materials as the backing material and the use of non-adhesive or anti-stick layers on the side of the backing contacting the printhead. For example, backings having softening temperatures higher than those encountered by the donor in the printing process are disclosed in unexamined Japanese patent application J6 1248-093-A, wherein copolymers containing acrylonitrile are proposed. Alternatively, materials that remain non-adhesive even though they may be softened by the heat of the printer are disclosed as anti-stick layers in unexamined Japanese patent application J8 0210-494-A, wherein polyethylene is proposed as a backing material. Both of these solutions suffer from high cost and limited availability of materials. Furthermore, while high softening and melting temperatures of polymers containing acrylonitrile give them improved heat resistance, this heat resistance hinders attempts to form them into film in an economically feasible manner. Even though polyethylene is more easily processed, due to its relatively low melting point of 137° C., it requires special treatment to give it the mechanical properties necessary for use as a backing for a donor.

Because none of these approaches has been totally satisfactory, a need remains to provide an efficient and effective means for preventing fouling of the printhead.

DISCLOSURE OF THE INVENTION

The present invention provides a donor element for use in thermal transfer processes, including both mass transfer and chemical transfer processes. The donor element of the invention comprises sheet or tape which comprises (a) a backing layer having an anti-stick surface comprising an organopolysiloxane-polyurea block copolymer, and (b) a heat-activated, image-forming material on the other surface of the backing layer.

The anti-stick material of the donor element has excellent high temperature stability as a result it demonstrates no discernible sticking or transfer to a thermal printhead under normal operating conditions, or to the image-forming material when stored in roll form under ambient conditions. Additionally, it preferably exhibits no tendency to accept transfer of the image-forming material to it when stored under ambient conditions.

Detailed Description

The backing layer utilized in the present invention is typically a thin, flexible material. For example, the caliper of the backing layer is generally from about 4 to about 20 micrometers, preferably from about 4 to about 8 micrometers. The backing layer may comprise a film of the organopolysiloxane polyurea block copolymer itself or, alternatively it may comprise a seperate material such as paper or a polymeric film commonly used for this purpose. Suitable materials for use as the backing layer include polymers such as polyester, polyamide, polycarbonate, fluorine polymers, polyethers, polyacetals, polyolefins and polyamides. Cellulose esters are also useful as the backing layer as are paper materials such as glassine paper and condenser paper (a polymer-impregnated paper material).

Specific examples of useful backing materials include poly(ethylene terephthalate) and poly(ethylene naphthalate) (PET and PEN respectively); cellulose acetate; polyvinylidene fluoride and poly(tetrafluoroethylene-co-hexafluoropropylene); polyoxymethylene; polystyrene, polyethylene, polypropylene, and methylpentane polymers; polyimide-amides and polyether-imides. Combinations or blends of two or more of these materials may also be used.

The heat-activated image-forming material utilized in the present invention may be comprised of a binder, such as a meltable wax or polymeric material to which has been added a colorant and other additives to improve transferability. Alternatively the image-forming material may be comprised of sublimable or heat-activated diffusable dye, or chemical species which, upon heating, transfer to the receptor and react with other materials contained in receptor to form a colored compound. Image-forming materials useful in the invention are known to those skilled in the art as are techniques for their preparation and application to a donor sheet.

The adhesion of the image-forming material to the backing layer may be improved by surface treatment of the backing layer or by interposing a priming layer between the image-forming material and the backing layer, as would be apparent to one skilled in the art. The exact nature of such a surface treatment or priming layer and the conditions necessary to achieve the same are dependent upon the surface treatment or priming layer utilized. However, because of the need to transfer portions of the image-forming material to the receptor, the surface treatment or priming layer should not adversely affect such transfer.

The organopolysiloxane-polyurea block copolymer anti-stick layer useful in the invention are segmented copolymers of the $(QW)_e$ type which are obtained through a condensation polymerization of a difunctional organopolysiloxane amine (which produces the soft segment (Q)) with a diisocyanate (which produces a hard segment (W)) and may include a difunctional chain extender such as a difunctional amine or alcohol, or a mixture thereof. Preferably the difunctional chain extender is a difunctional amine.

More specifically, the present invention provides organopolysiloxane-polyurea block copolymers comprising a repeating unit represented by Formula I, as follows Organopolysiloxane-polyurea block copolymer comprising the following repeating unit:

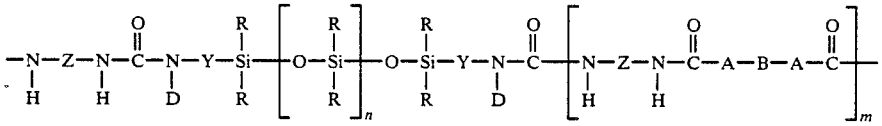

where:

Z is a divalent radical selected from the group consisting of phenylene, alkylene, aralkylene and cycloalkylene;

Y is an alkylene radical of 1 to 10 carbon atoms;

R is at least 50% methyl with the balance of the 100% of all R radicals being selected from the group consisting of a monovalent alkyl radical having from 2 to 12 carbon atoms, a substituted alkyl radical having from 2 to 12 carbon atoms, a vinyl radical, a phenyl radical, and a substituted phenyl radical;

D is selected from the group consisting of hydrogen, and an alkyl radical of 1 to 10 carbon atoms;

B is selected from the group consisting of alkylene, aralkylene, cycloalkylene, azaalkylene, cycloazaalkylene, phenylene, polyethylene oxide, polypropylene oxide, polytetramethylene oxide, polyethylene adipate, polycaprolactone, polybutadiene, and mixtures thereof, and a radical completing a ring structure including A to form a heterocycle;

A is selected from the group consisting of

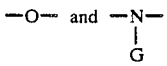

where G is selected from the group consisting of hydrogen, an alkyl radical of 1 to 10 carbon atoms, phenyl, and a radical which completes a ring structure including B to form a heterocycle;

n is a number which is 10 (preferably 70) or larger, and m is a number which can be zero to about 25.

In the one embodiment of the block copolymer Z is selected from the group consisting of hexamethylene, methylene bis-(phenylene), isophorone, tetramethylene, cyclohexylene, and methylene dicyclohexylene and R is methyl.

The organopolysiloxane-polyurea block copolymer useful in the present invention may be either organic solvent-compatible or water-compatible. As used herein, "compatible" means that the copolymer is soluble, dispersable or emulsifiable in organic solvent or water. The water-compatible copolymers contain ionic groups in the polymer chain. These water-compatible copolymers comprise the repeating unit of Formula II as follows:

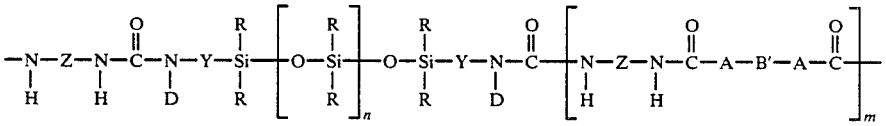

wherein Z, Y, R, D, A, n and m are as defined in Formula I and B′ is a divalent radical selected from the group consisting of alkylene, aralkylene, cycloalkylene, phenylene, polyethylene oxide, polypropylene oxide, polytetramethylene oxide, polycaprolactone, polybutadiene, and mixtures thereof, which contains a sufficient number of in-chain or pendant ammonium ions or pendant carboxylate ions to provide a block copolymer having an ionic content no greater than about 15%. More preferably the water-compatible copolymers comprise the repeating unit of Formula III as follows:

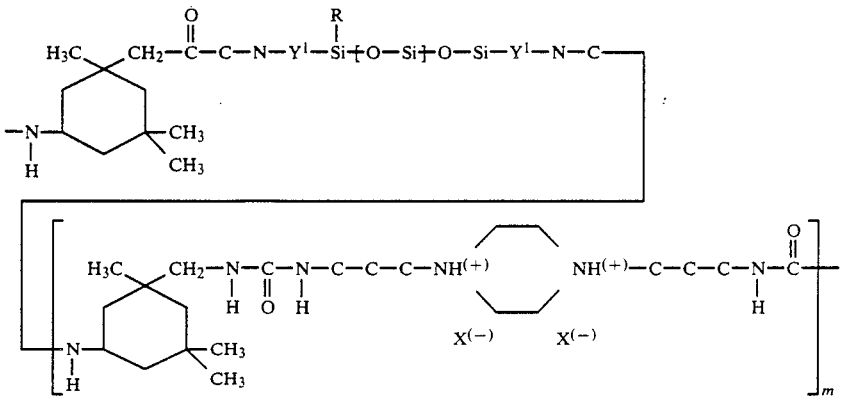

wherein m and n are as described above, $Y^1$ is selected from $C_3$ are $C_4$ alkylene and X is selected from chlorine bromine or $SO_4^{(-)}$.

The block copolymers useful in the invention may be prepared by polymerizing the appropriate components under reactive conditions in an inert atmosphere. The components comprise (1) a diamine having a number average molecular weight (Mn) of at least 1,000 and a molecular structure represented by Formula IV, as follows:

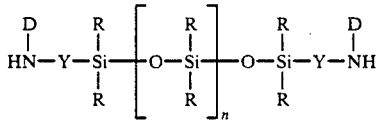

where R, Y, D and n are as defined in Formula I above;

(2) at least one diisocyanate having a molecular structure represented by Formula V, as follows:

OCN—Z—NCO where Z is as defined in Formula I above; and (3) up to 95 weight percent diamine or dihydroxy chain extender having a molecular structure represented by Formula VI, as follows:

H—A—B—A—H where A and B are defined above.

The combined molar ratio of silicone diamine, diamine and/or dihydroxy chain extender to diisocyanate in the reaction is that suitable for the formation of a block copolymer with desired properties. Preferably the ratio is maintained in the range of about 1:0.95 to 1:1.05.

More specifically solvent-compatible block copolymers useful in the invention may be prepared by mixing the organopolysiloxane diamine, diamine and/or dihydroxy chain extender, if used, and diisocyanate under reactive conditions, to produce the block copolymer with hard and soft segments respectively derived from the diisocyanate and organopolysiloxane diamine. The reaction is typically carried out in a reaction solvent.

Even more specific details regarding the manufacture of the block copolymers containing repeating units of Formula I are found in EPO Printed Application No. 0 250 248 published Dec. 23, 1987. The portions of this publication relating to the preparation of these polymers is incorporated herein by reference.

Water-compatible block copolymers containing recurring units of Formula II may be prepared by using chain extenders which introduce ionic groups into the polymer chain. One method for the production of this Formula II-containing polymer comprises polymerizing the following ingredients in a water soluble solvent having a boiling point less than 100° C.:

(1) a silicone diamine according to the following general formula:

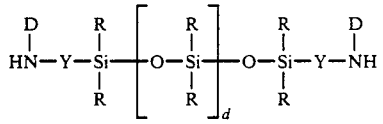

where Y and R are as described above with respect to Formula I;

$D^1$ is selected from the group consisting of hydrogen, an alkyl radical of 1 to 10 carbon atoms, phenyl, and an alkylene radical which completes a ring structure including Y to form a heterocycle; and d is a number of about 10 or larger; and (2) at least one diisocyanate having the formula:

$OCN—Z^1—NCO$ where:

$Z^1$ is a divalent radical selected from the group consisting of hexamethylene, methylene bis-(phenylene), tetramethylene, isophorone, cyclohexylene, and methylene dicyclohexyl; the molar ratio of diamine to diisocyanate being maintained in the range of from about 1:0.95 to 1:1.05; and (3) up to 95 weight percent chain extender selected from diamines, dihydroxy compounds, or mixtures thereof, some of which contain one or more in-chain or pendant amines, or one or more pendant carboxylic acid groups, the number of such groups being sufficient to provide, once ionized, an overall ionic content of said block copolymer which is no greater than about 15%; and ionizing said organopolysiloxane-polyurea block copolymer.

Several techniques may be used to incorporate the ionic groups into the polymer chain. One technique is the selection of chain extenders according to Formula VII $H—A—B^1—A—H$ where A and $B^1$ are defined above. For example, the use of chain extenders which contain in-chain amine groups, such as N-methyl diethanolamine, bis(3-aminopropyl) piperazine, N-ethyl diethanolamine, and diethylene triamine, and the like provide organpolysiloxane-polyurea block copolymers according to Formula I having reactive amine groups. These amine groups may then be ionized by neutralization with acid to form tertiary ammonium salts. Or, quaternary ammonium ions may be generated by reaction with alkylating agents such as alkyl halides, propiosultone, butyrosultone and the like.

Alternatively, organopolysiloxane-containing polymeric quaternary ammonium salts (ionenes) according to Formula I may be prepared by a two step procedure. The first step involves substitution of two moles of a tertiary amino alkyl amine or alcohol, such as 3-dimethylamino propylamine for one mole of a non-ionic chain extender of Formula IV in the reaction with the diisocyanates of Formula III. This yields a tertiary amine-terminated polyurethane or polyurea. The second step is treatment of the polyurea with a stoichiometric equivalent of reactive dihalide, such as 1,3-bis(-bromomethyl) benzene, 1,2-bis(p-bromomethylphonoxy) butane, N,N'-dimethyl-N,N'-bis(p-chloromethyl-phenyl)urea, 1,4-bis(2-methoxy-5-chloromethylphenoxy) butane, and diethylene glycol-bis(p-chloromethylphenyl) adipamide and the like, as described in U.S. Pat. No. 4,677,182, (Leir et al.), incorporated herein by reference, causing chain extension to form an organopolysiloxane polyurea or polyurethane block copolymer according to Formula I which has quaternary ammonium ion links.

In order to achieve the desired water compatibility or dispersibility, a certain minimum ionic content in the block copolymer is required. The exact amount varies with the particular polymer formulation, the molecular weight of the silicone segment, the nature of the copolymeric chain extenders selected, and other features of the individual copolymer. The preferred ionic content is the minimum amount required to yield stable aqueous dispersions while maintaining other desirable properties. Quantifying such minimum amount is difficult as the range will vary with each specific polymer system. The portion of the polymer chain to be defined as the ionic content must be determined. Finally, the ionic groups themselves may vary extensively in molecular weight, i.e., simple ammonium ions as opposed to an alkylated ionic group which may include the molecular weight of a long chain alkyl group. Generally, however, considering the weight of the ionic group to include only the simplest of constructions, e.g., a nitrogen atom, two adjacent carbon atoms in the polymer chain, and a halide ion as the molecular weight of the ion, a minimum of about 2% by weight of ionic content will yield a stable dispersion. Preferred copolymers incorporate from about 2% to about 10% ionic content, most preferably, from about 4% to about 8% ionic content, when calculated in this manner.

Anionic groups may also be added to the silicone block copolymers in order to provide water dispersibility. Where desirable, chain extenders of Formula VII are used which have carboxylic acid groups, such as 2,5-diaminopentanoic acid or 2,2-dimethylol propionic acid, as described in U.S. Pat. No. 4,203,883, incorporated herein by reference. The methods of preparation and other requirements are essentially the same for these carboxylic acid containing silicone block copolymers as for the analogous amine functional copolymers described above, i.e., the silicone block copolymer is prepared under anhydrous conditions in a water soluble solvent having a boiling point of less than 100° C. Generally, the carboxylic acid is neutralized with a slight molar excess of a tertiary amine such as triethylamine during the polymerization or after chain extension is complete, but prior to the dilution with water. A minimum of about 2–3% by weight of carboxylate anion is required for obtaining a stable dispersion, with 4–8% being preferred. However, anionic groups may reduce the thermal stability of the copolymer and thus their presence is not preferred.

Depending on ionic content and other structural features, these water-borne polymers can be either translucent or milky opaque; however, the coatings obtained after drying of the polymer are typically clear and very tough in nature.

The water-dispersible polymers are prepared initially in an un-ionized form by the methods described above, using water soluble solvents having lower boiling points than water. Suitable solvents include 2-butanone, tetrahydrofuran, isopropyl alcohol, or mixtures thereof. The amine containing silicone block copolymer may then be ionized in solution by protonation with stoichiometric amounts of strong acids such as hydrochloric or hydrobromic acid. Alternatively, the copolymer may be ionized by quaternization with an appropriate alkyl halide. The solution can then be diluted with water with vigorous agitation and the solvent evaporated under reduced pressure to give a completely aqueous dispersion of the ionized polymer. Although infinitely dilutable with water, most copolymers begin to reach their solubility limits at about 35–40% by weight. Preferred concentrations of water are from about 5% to about 15%.

The donor element of the invention may be prepared by a variety of techniques.

Preparation of the donor element may be easily accomplished. For example, the surface to be treated is first preferably cleaned to remove dirt and grease. Known cleaning techniques may be used. It may also be treated by corona discharge or application of a primer layer to improve adhesion of subsequently applied layers. One surface is then contacted with the solution of the organopolysiloxane-polyurea copolymer using a variety of techniques such as brushing, spraying, roll coating, curtain coating, knife coating, etc., and then processed at a time for a temperature so as to cause the polymer to form a dried layer on the surface. The dried copolymer layer is generally present at a level of from 0.05 to 4 $g/m^2$, more preferably from 0.2 to 4 $g/m^2$ and most preferably at a level of 0.3 $g/m^2$.

A wide range of processing temperatures may be used to form the antistick layer to form and adhere to the backing. However, the should not be so high as to degrade either the surface being treated or antistick layer.

The article of the invention can also be prepared by continuous in-line manufacturing processes. The antistick layer may be applied to either unoriented, partially oriented, or fully oriented webs. Treated unoriented or partially oriented webs may be further oriented if desired. Conventional orientation conditions may be used in such processes. Thus, the web may be stretched in the lengthwise direction by known techniques and subsequently stretched in the crosswise direction using known techniques. Alternatively, biaxially stretched in both directions at the same time.

A particularly useful manufacturing process comprises the steps of stretching the web in the lengthwise direction at 80°-95° C., applying the antistick layer to the uniaxially oriented web, stretching the treated, uniaxially oriented web at 100°-120° C. in the crosswise direction, and then heat setting the biaxially oriented web at 200°-250° C. Typically webs are oriented by being stretched to from 1 to 5 times their original dimension wherein the length to width stretch ratio may vary from 1:1 to 1:5 and from 5:1 to 1:1. Other stretch ratios may be used if desired.

After the antistick layer has been coated, a layer of image-forming material may be applied to the other side of the backing using known techniques. The resultant film may then be cut to desired widths and lengths.

The present invention will be further explained by reference to the following examples wherein all percents are percents by weight unless otherwise specified. These examples serve to further illustrate the present invention and do not limit it.

The following block copolymers were prepared:

Block Copolymer A

To a solution of 65 gm of 5000 number average molecular weight (Mn) polydimethyl siloxane (PDMS) diamine (prepared according to Example 2 of EPO Printed Application No. 0 250 248), 15.2 gm of N,N'-bis-(3 aminopropyl) piperazine (bisAPIP) in 530 ml of isopropyl alcohol (IPA) at 25° C. was added 19.8 gm of isophorone diisocyanate (IPDI) slowly over a 5 minute period. The exothermic reaction was controlled by means of an ice water bath to maintain the temperature at 15°-25° C. during the addition. The viscosity rose rapidly toward the end of the addition and the viscous yet clear reaction was stirred for an additional 1 hour. This provided a 20 percent by weight solution of the block copolymer in IPA. The block copolymer had 65 percent by weight PDMS soft segments and 35 percent by weight bisAPIP/IPDI hard segments.

Block Copolymer B

Example 1 was repeated. The resulting solution of the block copolymer was combined with 12.67 cc of 12(N) HCl. After stirring for 10 minutes the clear syrup was stirred vigorously while 500 ml of warm (45° C.) water was rapidly added. This provided a translucent solution which was transferred to a rotary evaporator and stripped under aspiration pressure to remove the IPA (530 ml). The resulting concentrate was diluted with 400 ml of water to provide the block copolymer dispersed at 10% solids in water. The block copolymer had 65 weight percent PDMS soft segments and 35 weight percent bisAPIP/IPDI hard segments.

Block Copolymer C

A 250 mil three neck flask was charged with 5 g of 5000 Mn PDMS diamine, 1.29 g of bisAPIP, 0.56 g of 2-methylpentamethylene diamine (MPMD) and 40 g of isopropyl alcohol. The resulting solution was cooled to 20° C. with an ice bath while 2.76 g of IPDI was added. This provided the silicone polyurea as a very viscous yet clear solution in IPA. The block copolymer had 52 weight percent PDMS soft segments and 48 weight percent hard segments (35 weight percent bisAPIP-/IPDI and 13 weight percent MPMD).

Block Copolymer D

A solution of 20.0 g polybutadiene diol (PBD) of 1,454 MW, available as Polybd TM R-45M from ARCO Chemical Co., and 18.28 g isophorone diisocyanate in 200 g 2-butanone was stirred and heated under reflux with 3 drops of dibutyltin dilaurate catalyst under argon for 3 hours. The reaction was cooled to room temperature, and a solution of 50.0 g PDMS diamine of 5,014 MW in 50 g 2-butanone was added rapidly. To the resulting clear solution was added dropwise with rapid stirring, a solution of 11.72 g bisAPIP. The viscosity of the reaction mixture rose rapidly, but the solution remained clear. After 15 minutes, the block copolymer, having a composition of 70 weight percent soft segments (50 weight percent PDMS and 20 weight percent PBD) and 30 weight percent hard segment (bisAPIP-/IPDI), was acidified with 19.5 ml of 6N HCl. The solution become hazy, followed rapidly by the formulation of a globular precipitate. This was readily dispersed by pouring into 1,100 ml water with rapid agitation. The solvent was stripped under vacuum and concentrated to 1,000 g to yield a milky-white, stable dispersion in water at 10% solids. Cast films of this block copolymer were clear, yet somewhat brittle. However, coatings showed excellent adhesion to poly(ethylene terephthalate) (PET) film.

Block Copolymer E

A solution of 15.0 g of amine terminated PPO having a molecular weight of 2,000 (Jeffamine TM, D-2000), 50.0 g PDMS diamine with a molecular weight of 5,014, and 13.0 bisAFIP in 250 ml IPA was treated dropwise with 22.0 g IPDI. The temperature was held at 25°-30° C. during the addition by means of a water bath. After addition was complete, the clear, highly viscous solution was stirred for 15 minutes. 22 ml of 6N HCl was added and the mixture thickened almost to a paste. The block copolymer had 65 weight percent soft segments (50 weight percent PDMS and 15 weight percent PPO) and 35 weight percent bisAPIP/IPDI hard segments. Dilution with 1,100 ml $H_2O$ and concentration to 10% solids gave a translucent dispersion in water. Films obtained after casting were crosslinked during drying by adding a 10% aqueous solution of N,N'-bis(hydroxymethyl) ethylene urea (0.156 g per 1.0 g polymer dispersion) and a catalytic amount of $ZnCl_2$ (0.1%, based on solids) prior to coating. Such coatings were clear, very tough, insoluble in solvents and water, and exhibited excellent adhesion to surfaces such as PET.

Block Copolymer F

To a solution of 65 g of PDMS amine and 15.6 g of dipiperidyl propane (DIPIP), from Rilly Tar and Chemical, in 400 g of IPA was added 19.4 g IPDI with stirring over a 5 minute period. The temperature was kept below 30° by means of an ice bath. After addition the viscous, clear solution was stirred for 30 minutes to provide the block copolymer at 20% solids. The block copolymer comprises 65 weight percent PDMS soft segments and 35 weight percent DIPIP/IPDI hard segments.

Block Copolymer G

A solution in isopropylalcohol of 25 g of PDMS amine (20,171 MW), 30 g amine terminated polytetramethylene oxide (10,000 MW) (PPDA) and 21.29 g of DIPIP was treated with 23.71 g of IPDI with stirring at 20°-25° C. The resulting polymer solution (20% solids) had 50 weight percent soft segments (25 weight percent PDMS and 30 weight percent PPDA) and 45 weight percent DIPIP/IPDI hard segments.

Block Copolymer H

Following the procedure described in the preparation of block copolymer E above a silicone polybutadine polyurea was prepared starting from 10 g polybutadine diol (PBD) (1545 MW), 17.75 g of IPDI, 60 g PDMS amine (5014 MW) and 12.25 g bisAPIP in 400 g 2-butanone. The resulting block copolymer had 70 weight percent soft segments (60 weight percent PDMS and 10 weight percent PBD) and 30 weight percent bis(APIP-/IPDI hard segments. Addition of 20.4 mils of 6NHCl and transfer into $H_2O$ (1100 ml) gave a milky yet stable dispersion.

EXAMPLES 1-8

A series of coating formulations were made each of which employed one of block copolymers A-H. Each of the above-described polymer solutions were diluted to 5% polymer content by weight in IPA or water. In the case of the water based coating solutions, the pH of the coating solution was adjusted to 2 by the addition of 12(N)HCl. Each of the resulting coating solutions was applied to unprimed PET film available from Teijin (6.35 microns thick) using a #4 Mayer bar and dried in an air circulating oven for 20 seconds at 66° C. (water based coating examples) and 121° C. (IPA based coating examples).

The resulting films each had from 0.3 to 0.4 g/m² of the block copolymer on their surface. They were then run through a Kyocera printer having a printhead with an average head resistance ($R_A$) of 890 ohms (Q) so that the block copolymer contacted the printhead. During the test the printhead voltage was increased gradually from 11 volts until the coating began to stick to the printhead. The film created a chattering noise when it began to stick to the printhead. Table 1 lists the results of these tests. In this table, Voltage tolerance (V) refers to the maximum printhead voltage at which no sticking was observed. Energy per dot (joules/cm² (J/cm²)) is calculated according to the formula $$\frac{\left(\frac{V^2}{R_A}\right)_t}{A}$$

where V and $R_A$ are as defined above, A is the area of a dot and is equal to 0.021 mm² and t is the burn time and is equal to $4.48\times10^{-3}$ seconds.

TABLE I

| EXAMPLE | ANTI-STICK TYPE | VOLTAGE TOLERANCE (V) | ENERGY/DOT (J/cm²) |
|---|---|---|---|
| 1 | A | 17 | 6.9 |
| 2 | B | 17 | 6.9 |
| 3 | C | 15 | 5.4 |

TABLE I-continued

| EXAMPLE | ANTI-STICK TYPE | VOLTAGE TOLERANCE (V) | ENERGY/DOT (J/cm²) |
|---|---|---|---|
| 4 | D | 14 | 4.7 |
| 5 | E | 19 | 8.6 |
| 6 | F | 14.4 | 4.9 |
| 7 | G | 18 | 7.8 |
| 8 | H | >20 | >9.6 |

What is claimed is:

1. A donor element for thermal printing comprising a backing layer having one surface comprising an anti-stick material comprising a water-compatible organopolysiloxane-polyurea block copolymer, and a heat-activated, image-forming material on the other surface thereof, wherein said block copolymer is a segmented copolymer obtained via condensation of a difunctional organopolysiloxane amine with a diisocyanate.

2. A donor element according to claim 1 wherein said block copolymer is soluble in water.

3. A donor element according to claim 1 wherein said block copolymer is emulsifiable in water.

4. A donor element according to claim 1 wherein said block copolymer has the repeating unit

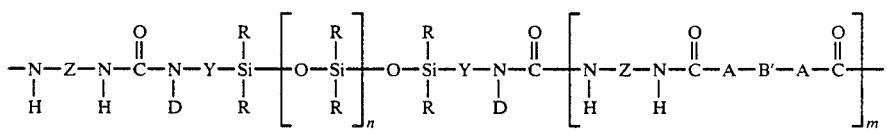

where:

Z is a divalent radical selected from the group consisting of phenylene, alkylene, aralkylene and cycloalkylene;

Y is an alkylene radical of 1 to 10 carbon atoms;

R is at least 50% methyl with the balance of the 100% of all R radicals being selected from the group consisting of a monovalent alkyl radical having from 2 to 12 carbon atoms, a substituted alkyl radical having from 2 to 12 carbon atoms, a vinyl radical, a phenyl radical, and a substituted phenyl radical;

D is selected from the group consisting of hydrogen, and an alkyl radical of 1 to 10 carbon atoms;

B' is a divalent radical selected from the group consisting of alkylene, aralkylene, cycloalkylene, phenylene, polyethylene oxide, polypropylene oxide, polytetramethylene oxide, polycaprolactone, polybutadiene, and mixtures thereof, which contains a sufficient number of in-chain or pendant ammonium ions or pendant carboxylate ions to provide a block copolymer having an ionic content no greater than about 15%;

A is selected from the group consisting of

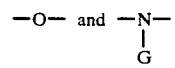

where G is selected from the group consisting of hydrogen, an alkyl radical of 1 to 10 carbon atoms, phenyl, and a radical which completes a ring structure including B to form a heterocycle;

n is a number which is 10 or larger, and m is a number which can be one to about 25.

5. A donor element according to claim 4 wherein said ionic content comprises from about 2% to about 10% by weight of said block copolymer.

6. A donor element according to claim 5 wherein said ionic content comprises from about 4% to about 8% by weight of said copolymer.

7. A donor element according to claim 4 wherein said block copolymer has the repeating unit

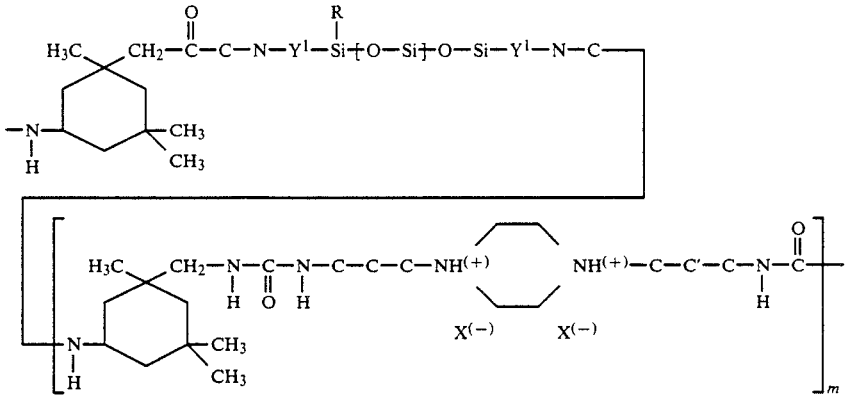

wherein $Y^1$ is selected from $C_3$ to $C_4$ alkylene and X is selected from chlorine, bromine and $SO_4$.

8. A donor element according to claim 1 wherein said backing layer is an organic material.

9. A donor element according to claim 8 wherein said organic material is a polyester.

10. A donor element according to claim 9 wherein said polyester is poly(ethylene terephthalate).

11. A thermal printing donor element according to claim 1 having an ionic content of at least 2% by weight.

12. A thermal printing donor element according to claim 1 having an ionic content of from 2% to 15% by weight.

13. A thermal printing donor element according to claim 12 having an ionic content of from 2% to 10% by weight.

14. A thermal printing donor element according to claim 13 having an ionic content of from 4% to 8% by weight.

15. A donor element for thermal printing comprising a backing layer having a organopolysiloxane-polyurea block copolymer anti-stick surface which block copolymer has the repeating unit

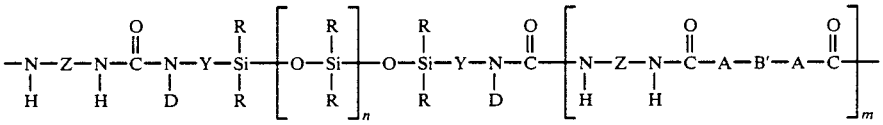

wherein:

Z is a divalent radical selected from the group consisting of phenylene, alkylene, aralkylene and cycloalkylene;

Y is an alkylene radical of 1 to 10 carbon atoms;

R is at least 50% methyl with the balance of the 100% of all R radicals being selected from the group consisting of a monovalent alkyl radical having from 2 to 12 carbon atoms, a substituted alkyl radical having from 2 to 12 carbon atoms, a vinyl radical, a phenyl radical, and a substituted phenyl radical;

D is selected from the group consisting of hydrogen, and an alkyl radical of 1 to 10 carbon atoms;

B′ is a divalent radical selected from the group consisting of alkylene, aralkylene, cycloalkylene, phenylene, polyethylene oxide, polypropylene oxide, polytetramethylene oxide, polycaprolactone, polybutadiene, and mixtures thereof, which contains a sufficient number of in-chain or pendant ammonium ions or pendant carboxylate ions to provide a block copolymer having an ionic content no greater than about 15%;

A is selected from the group consisting of

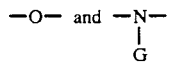

where G is selected from the group consisting of hydrogen, an alkyl radical of 1 to 10 carbon atoms, phenyl, and a radical which completes a ring structure including B to form a heterocycle;

n is a number which is 10 or larger, and m is a number which can be one to about 25.

16. A donor element according to claim 15 wherein Z is selected from the group consisting of hexamethylene, methylene bis(phenylene), tetramethylene, isophorone, cyclohexylene, and methylene dicyclohexyl.

17. A donor element according to claim 16 wherein said $B^1$ unit has an ionic content of no greater than about 15 percent by weight of said polymer.

18. A donor element according to claim 17 wherein said ionic content comprises from about 2 percent to 15 percent by weight of said polymer.

19. A donor element according to claim 18 wherein said ionic content comprises from about 4 percent to 8 percent by weight of said polymer.

* * * * *

UNITED STATES PATENT AND TRADEMARK OFFICE

CERTIFICATE OF CORRECTION

PATENT NO. : 5,001,012

DATED : March 19, 1991

INVENTOR(S) : MANISHA SARKAR AND CHARLES M. LEIR

It is certified that error appears in the above-identified patent and that said Letters Patent is hereby corrected as shown below:

Column 6, line 33, correct "bisAFIP" to --bisAPIP--.

Column 11, line 15, correct "mils" to --ml--.

Column 11, line 43, correct "(Q)" to --(Ω)--.

Column 11, line 16, correct "(1100ml)" to --(1100 mils)--.

Signed and Sealed this

Fifth Day of January, 1993

*Attest:*

*Attesting Officer*

DOUGLAS B. COMER

*Acting Commissioner of Patents and Trademarks*